US007592115B2

(12) United States Patent
Nakamura et al.

(10) Patent No.: US 7,592,115 B2
(45) Date of Patent: Sep. 22, 2009

(54) CARRIER FOR ELECTROSTATIC LATENT IMAGE DEVELOPER, PRODUCTION METHOD THEREOF, ELECTROSTATIC LATENT IMAGE DEVELOPER, AND IMAGE-FORMING DEVICE

(75) Inventors: Yasushige Nakamura, Ebina (JP); Sadaaki Yoshida, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 418 days.

(21) Appl. No.: 11/249,279

(22) Filed: Oct. 14, 2005

(65) Prior Publication Data

US 2006/0269863 A1 Nov. 30, 2006

(30) Foreign Application Priority Data

May 25, 2005 (JP) ..... 2005-152601

(51) Int. Cl.
*G03G 9/08* (2006.01)
*G03G 9/113* (2006.01)
*G03G 15/01* (2006.01)

(52) U.S. Cl. ..... 430/110.3; 430/45.56; 430/111.32; 430/111.33; 430/111.35; 430/111.41; 430/124.4; 399/223; 399/336

(58) Field of Classification Search ..... 430/111.1, 430/111.35, 111.32, 111.33, 111.3, 111.31, 430/111.41, 110.3, 45.56, 124.4; 399/223, 399/299, 336
See application file for complete search history.

(56) References Cited

U.S. PATENT DOCUMENTS

| | | | | |
|---|---|---|---|---|
| 4,386,840 | A * | 6/1983 | Garthwaite et al. | 399/337 |
| 6,387,582 | B2 * | 5/2002 | Kayamoto et al. | 430/111.1 |
| 7,254,363 | B2 * | 8/2007 | Nakamura et al. | 399/336 |
| 2003/0190537 | A1 * | 10/2003 | Nakamura et al. | 430/45 |

FOREIGN PATENT DOCUMENTS

| | | | |
|---|---|---|---|
| EP | 0936507 | A2 * | 8/1999 |
| JP | A 03-73968 | | 3/1991 |
| JP | A 08-69185 | | 3/1996 |
| JP | A 08-179570 | | 7/1996 |
| JP | A 10-148972 | | 6/1998 |
| JP | A 2001-51456 | | 2/2001 |
| JP | A 2001-312103 | | 11/2001 |

* cited by examiner

*Primary Examiner*—Janis L Dote
(74) *Attorney, Agent, or Firm*—Oliff & Berridge, PLC

(57) ABSTRACT

A carrier for electrostatic latent image developer, including a core material and at least two or more resin-coated layers formed on the surface of the core material, wherein the resin-coated layers include a siloxane bond-containing coating resin containing an organic metal compound and a conductive material, the metal contained in the organic metal compound in the innermost resin-coated layer has an ionization potential of less than 7 eV, and the metal contained in the organic metal compound in the outermost resin-coated layer has an ionization potential of 7 eV or more.

20 Claims, 1 Drawing Sheet

CARRIER FOR ELECTROSTATIC LATENT IMAGE DEVELOPER, PRODUCTION METHOD THEREOF, ELECTROSTATIC LATENT IMAGE DEVELOPER, AND IMAGE-FORMING DEVICE

CROSS-REFERENCE TO RELATED APPLICATIONS

This application claims priority under 35 USC 119 from Japanese Patent Application No. 2005-152601, the disclosure of which is incorporated by reference herein.

BACKGROUND OF THE INVENTION

1. Field of the Invention

The present invention relates to a carrier for electrostatic latent image developer that is used in developing an electrostatic latent image formed, for example, by an electrophotographic or electrostatic recording process, a production method thereof, an electrostatic latent image developer, and an image-forming device.

2. Description of the Related Art

Processes of visualizing image information via forming an electrostatic latent image by an electrophotographic process or the like are currently used in a variety of fields. In the electrophotographic process, an image is visualized by forming an electrostatic latent image on the surface of a photoreceptor by charging and exposure, developing the electrostatic latent image into a toner image with an electrostatic latent image developer (hereinafter, sometimes referred to simply as "developer") including toner, and then transferring and fixing the toner image. The developers currently used include two-component developers containing a toner for developing an electrostatic latent image (hereinafter, sometimes referred to simply as "toner") and a carrier for electrostatic latent image developer (hereinafter, sometimes referred to simply as "carrier") and one-component developers such as magnetic toners that are used alone. The two-component developers are used widely because of their superior controllability, because the carrier therein plays the roles, for example, of agitating, transporting and charging the developer and thus, the functions of the developer are separated.

Generally, carriers are broadly grouped into carriers having a resin-coated layer on the surface thereof and carriers having no resin-coated layer, but the resin-coated carriers are superior when various electrostatic properties and the lifetime of developer are considered, and thus various resin-coated carriers have been developed and commercialized.

Recently, printing machines for the electrophotographic process allowing ultrahigh-speed on-demand printing have been studied to replace the offset printing machines used for printing newspapers and direct mailings. In the electrophotographic process, developments are in progress aimed at coping with expansion in the width of paper and increasing practical printing volume by increasing speed. However, printing at high speed, for example, at a linear velocity of 1,000 mm/sec or more (output of about 400 sheets of A4 paper per minute) raises the stress applied to the developer, which is proportional to the square of the speed, to a level beyond comparison with that applied in low-speed desktop machines.

Generally, for the purpose of optimizing printing performance, a conductive material such as carbon black for adjustment of electric resistivity is used in the resin-coated layer on the carrier surface, but in high-speed color machines operating at a linear velocity of 1,000 mm/sec or more, the conductive material is often separated, alone or together with the coating resin, from the carrier by the stress applied to the developer, causing the problem of contamination of the toner by the conductive material. Particlarly when color toners are used, the influence is amplified because of deterioration in image color reproducibility.

As for maintenance, it is necessary to change the developer at a certain interval even if the speed is raised, and accordingly, longer lifetime of developer is demanded especially for high-speed machines. Thus, it is necessary to prevent separation of the conductive material such as carbon black from the coating material of a carrier in high-speed color printers (printing machines) and obtain durability equivalent to or greater than that of monochrome machines.

For prevention of the separation of carbon black form the carrier for color toners, a method has been proposed of coating a carbon black-containing coating agent on the magnetic core (core material) of a carrier and then additionally coating a non-carbon black-containing coating agent thereon as a surface-coat layer (e.g., Japanese Patent Application Laid-Open (JP-A) No. 8-179570, the disclosure of which is incorporated by reference herein). However, the method prohibits control of the hardness of the surface and internal coat layers, the durability of the surface-coat layer is not satisfactory, and further, although separation of carbon black is not observed at an early stage, the coating agent is scraped off during continuous use, causing noticeable contamination by carbon black.

Alternatively, a bilayer coat including an internal coat layer of styrene resin or a styrene-acrylic resin has been proposed (e.g., JP-A No. 3-73968, the disclosure of which is incorporated by reference herein). In this proposal, disclosed is an example of using a styrene or acrylic resin for the internal coat layer and a silicone resin for the surface-side coat layer, because when a styrene or acrylic resin having a low surface tension and a low thermal decomposition temperature is used for the surface-side coat layer, the developing performance is deteriorated by the contamination due to filming of the toner. However, when exposed to a temperature of 200° C. or higher for hardening the silicone resin, the acrylic resin decomposes, resulting in separation of the coat layer and prohibiting production of a desirable carrier.

As for a fixing system, it is particularly desirable to avoid paper jamming and generation of paper powder formed by the friction between a device and paper in high-speed machines. Thus, non-contact fixing processes in which contact with medium is limited and paper jamming is caused extremely rarely are desirable. Generally, among such processes, oven fixing and flash fusing (light fixing) are promising. In particular, printing machines using a flash fusing process using light are attracting attention, because they give a high-quality image, are compatible with various media, allow quick start without standby power, and are higher in reliability, for example, in resistance to paper jamming.

Accordingly, it is important to stabilize developer in particular when a flash fusing process is employed, and thus, stabilization of the properties of developer, for example, increase in the durability of carrier, is an important issue.

SUMMARY OF THE INVENTION

The present invention has been made in view of the above circumstances. Accordingly, in the development of high-speed electrophotographic printers, the present invention provides a long-lasting electrostatic latent image developer that provides a vivid color image. The present invention also provides a carrier for electrostatic latent image developer for obtaining the electrostatic latent image developer and a production method thereof, as well as an image-forming device using the electrostatic latent image developer.

A first aspect of the present invention provides a carrier for electrostatic latent image developer, comprising a core material and two or more resin-coated layers formed on the surface of the core material, wherein the resin-coated layers comprise a siloxane bond-containing coating resin containing an organic metal compound and a conductive material, a metal contained in the organic metal compound in the innermost resin-coated layer has an ionization potential of less than 7 eV, and a metal contained in the organic metal compound in the outermost resin-coated layer has an ionization potential of 7 eV or more.

A second aspect of the invention provides an electrostatic latent image developer comprising a toner and a carrier, wherein the carrier is the carrier for electrostatic latent image developer of the first aspect.

A third aspect of the invention provides an image-forming device comprising: at least one toner image-forming unit that forms a full color toner image using at least three developers of colors including at least cyan, magenta, and yellow, each developer including a color toner and a carrier; and a fixing unit that fixes the toner image on a recording medium by performing flash fusing, wherein the color toners contain an infrared absorbent, the carrier includes a core material and two or more resin-coated layers comprising a siloxane bond-containing coating resin containing an organic metal compound and a conductive material on the surface of the core material, a metal contained in the organic metal compound in the innermost resin-coated layer has an ionization potential of less than 7 eV, and a metal contained in the organic metal compound in the outermost resin-coated layer has an ionization potential of 7 eV or more.

DETAILED DESCRIPTION OF THE INVENTION

Figure 1:
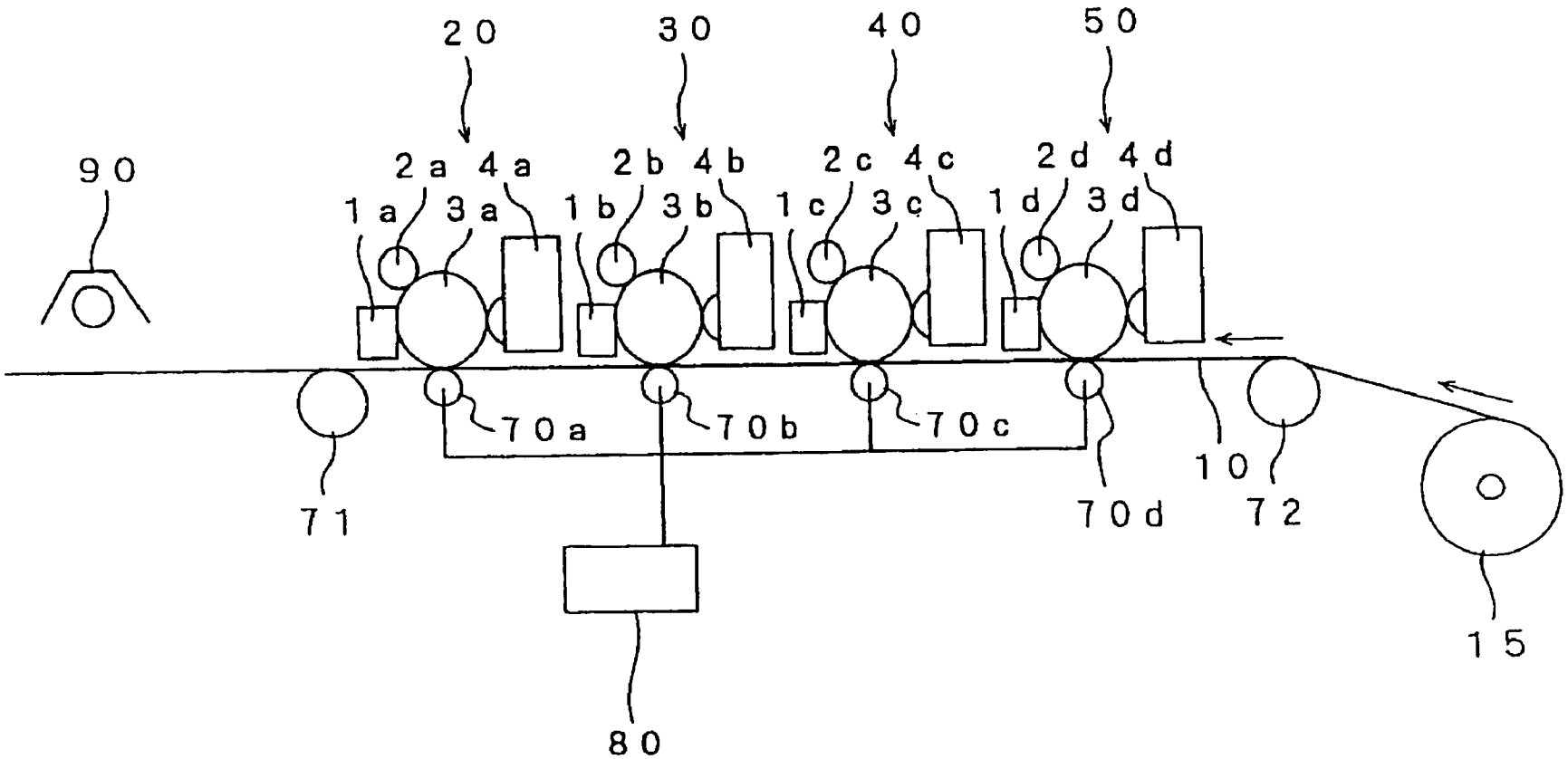
FIG. 1 is a schematic view illustrating the configuration of an example of the image-forming device according to the present invention.

Hereinafter, the present invention will be described in detail.

<Carrier for Electrostatic Latent Image Developer and Production Method Thereof>

The carrier for electrostatic latent image developer according to the present invention is a carrier for electrostatic latent image developer including a core material and two or more resin-coated layers on the surface of the core material, wherein each of the resin-coated layers is made of a siloxane bond-containing coating resin containing an organic metal compound and a conductive material, the metal contained in the organic metal compound in the innermost resin-coated layer has an ionization potential of less than 7 eV, and the metal of the organic metal compound contained in the outermost resin-coated layer has an ionization potential of 7 eV or more.

Resins having siloxane bonds containing silicon and oxygen atoms (hereinafter, sometimes referred to as "silicone resin") have been used widely as a coating resin for carriers, because they have a small intermolecular attracting force and a low critical surface tension because of the silicon atom's unique electron structure. However, they also have a drawback in that they have the low adhesiveness to a core material because of their low critical surface tension. In addition, silicone resins that have been thermally hardened are generally brittle and low in strength as a carrier-coating resin.

Although the hardening characteristics of silicone resins have been studied, they have been studied for a single-layer coat and not for a multilayer coat. A demerit of the single-layer coat, low abrasion resistance, has been compensated for increase in coat thickness (coated resin thickness), and the point when the coat thickness is diminished entirely or to a certain limit by abrasion is considered the end of the lifetime of the coat.

However, as described above, when a coating resin contains a conductive material such as carbon black, the phenomenon of the conductive material separating from the carrier alone or together with the coating resin causes serious problems for multicolor printing, and is a challenge in particular for the resin-coated carriers.

Generally, an organic metal catalyst is used in preparing (hardening) a siloxane bond-containing resin for the purpose of controlling the hardening speed. The inventors have found that the hardening speed of silicone resin at a particular temperature and the state of the film after hardening vary according to the kind of metal contained in the organic metal catalyst, and that the difference in the hardening speed, etc. is dependent on the ionization potential of the metal.

Specifically, it was found that when the ionization potential (hereinafter, sometimes referred to as "IP") of the metal contained in the organic metal catalyst was less than 7 eV, the hardening speed at a particular temperature decreased and the hardness and abrasion resistance of the resin after hardening decreased, but the coating state was uniform and the resin was superior in adhesiveness with the core material. On the other hand, when the ionization potential of the metal contained in the organic metal compound was 7 eV or more, the hardening speed increased and the hardness and abrasion resistance of the resin after hardening increased, but the coating state was rather uneven and the resin was less adhesive to the core material.

In the present invention, the ionization potential of a metal means the minimum energy needed for abstracting an electron from the neutral atom, i.e., the first ionization potential. The values used are based on the description, for example, in Chemical Handbook (Basic) (revised 3rd. Ed., Chemical Society of Japan), the disclosure of which is incorporated by reference herein.

The inventors tried to improve the durability of the carrier having a resin-coated layer containing a conductive material by using the above-described properties of the organic metal compound. As a result, they have found that it is possible to overcome the problems described above by forming two or more resin-coated layers and adding an organic metal compound containing a metal having an ionization potential of less than 7 eV to the innermost layer, among the two or more resin-coated layers, and an organic metal compound containing a metal having an ionization potential of 7 eV or more to the outermost layer.

It was found that it is possible to preserve the surface hardness of coated resin at a certain level or greater and improve the uniformity of coated layers and the adhesiveness between the coated resin as a whole and the core material, by using an organic metal compound containing a metal having a lower ionization potential in the innermost layer coating resin, which is required to be adhesive to the carrier core material, which is normally a metal, and by using a metal higher in ionization potential, on the contrary, in the outermost layer, which is required to have surface hardness.

The reason for the above effect is that, in the configuration according to the present invention, it is possible to obtain a superior adhesiveness to the core material and a superior uniformity as a hardened film, although the hardness of the innermost layer is low, by hardening the two or more coated resin layers at the same temperature, and thus, even when a layer higher in hardness is formed on the innermost layer surface, the layers adhere more tightly than when they are formed directly on the core material surface, and as a whole, the uniformity and the adhesiveness of coated resin layers is improved.

The ionization potential of the metal contained in the organic metal compound in the innermost layer is less than 7 eV and preferably 6 eV or less. An ionization potential of 7 eV or more may lead to acceleration of hardening and consequently may easily cause unevenness of the coated film. Accordingly for prevention of exposure of the core material and elongation of the lifetime, it is necessary to preserve the uniformity of carrier coat by adjusting the IP of the metal contained in the innermost layer to less than 7 eV.

On the other hand, the ionization potential of the metal contained in the organic metal compound in the outermost layer is 7 eV or more. An ionization potential of less than 7 eV may lead to decrease in hardening speed, making the carrier vulnerable to abrasion and thus lower in durability and causing contamination due to separation of carbon black in the early phase of continuous printing.

The metal having an ionization potential of less than 7 eV is not particularly limited, but aluminum (IP: 5.99 eV), titanium (IP: 6.8 eV), calcium (IP: 6.13 eV), and barium (IP: 5.21 eV) are preferable. The metal having an ionization potential of 7 eV or more is also not particularly limited, but manganese (IP: 7.44e V), tin (IP: 7.34 eV), cobalt (IP: 7.9 eV), and zinc (IP: 9.39 eV) are preferable.

In an embodiment, the metal contained in the organic metal compound in the innermost layer is one or more metals selected from aluminum, titanium, calcium, and barium, and the metal contained in the organic metal compound in the outermost layer is one or more metals selected from manganese, tin, cobalt, and zinc.

In particular, the combination of aluminum and tin is effective in controlling hardening of the coat resin.

The configuration of the coated resin layers of the carrier for electrostatic latent image developer according to the present invention can be confirmed by dissolving the core material by immersing the carrier in sulfuric acid and observing the remaining resin-coated layers under a transmission electron microscope. Alternatively, the metals contained in the resin layers can be confirmed, by dissolving the resin in an alkaline solution (e.g., sodium carbonate solution) in a small amount and analyzing the metals by emission spectrochemical analysis (ICP) or atomic absorption analysis.

Hereinafter, the configuration of the carrier for electrostatic latent image developer according to the present invention will be described, together with the production method thereof. Examples of the materials for the core material (core) for use in the present invention include ferrite, magnetite, iron powder, and the like, and in particular, manganese ferrite, which is higher in magnetic force and almost spherical, is advantageous from the viewpoint of elongation of lifetime. More preferable is manganese ferrite represented by the following Formula (1):

$$(MnO)x(Fe_2O_3)y \qquad \text{Formula (1)}$$

In the Formula above, x and y represent molar ratios; x+y=100; and x=10 to 45. When the molar ratio x of MnO is less than 10 mol %, the core material after formation of particles may be less stable, causing fluctuation in resistivity, for example, by stress and deterioration in developing property. A core material having a molar ratio x of MnO exceeding 45 mol % is also undesirable, because it may easily become undefined in shape, and may cause adhesion of the toner onto carrier surface and then fluctuation in resistivity by filming by the stress or others in the developing device.

In addition to the Mn metal, the core material preferably contains silicon (Si) in an amount of 0.1 to 0.5 parts by mass based on silicon dioxide ($SiO_2$) conversion per 100 parts by mass of the core material. The silicon content has a close relationship with the carrier shape; and increase in the silicon content may lead to decrease in the width of the grooves between grain boundaries, increase in the smoothness of surface and the flowability of the particles, and consequently to elongation of lifetime and stabilized printing of sharp line images. The content of Si, for conversion to silicon dioxide ($SiO_2$), can be determined by X-ray photoelectron spectroscopy.

A content of less than 0.1 parts by mass may lead to widening of the grooves and penetration of the coating resin into the grooves, making it difficult to form a uniform film. Alternatively, a content of more than 0.5 parts by mass may lead to excessive increase in surface smoothness and thus disappearance of the coat-anchoring effect, which in turn leads to easier exfoliation and remarkable decrease in charge.

The saturation magnetization of the carrier is preferably in the range of 65 to 95 $Am^2/kg$.

The manganese ferrite is prepared, for example, by blending the metal oxides, metal carbonate salts, or metal hydroxides of Mn and Fe in amounts of 20 mol % as MnO and 80 mol % as $Fe_2O_3$, and it is preferable to add $SiO_2$ in a small amount, particularly for the purpose of controlling the surface shape of the ferrite core. A larger Si content is effective in making the core surface smooth.

After addition of water, the mixture is pulverized and blended in a wet ball mill for 10 hours, dried, and then kept at 950° C. for 4 hours. The mixture is pulverized in a wet ball mill for 24 hours, to give particles having a particle size of 5 μm or less. The slurry is granulated and dried, kept in a nitrogen environment at 1,300° C. for 6 hours, pulverized, and classified into particles having a desirable particle size distribution.

The core material favorable for use in the present invention is a ferrite-based core material preferably having a volume average particle size in the range of 30 to 90 μm and more preferably in the range of 50 to 80 μm. A core material having a volume average particle size of less than 30 μm results in easier adhesion of carrier, while that of more than 90 μm may lead to deterioration in image quality.

The resin used for coating the surface of the core material for use in the present invention surface is a siloxane bond-containing resin (silicone resin).

Typical examples of the silicone resins include straight silicone resins having a methyl or phenyl group on the side chain such as methylsilicone resin, phenylsilicone resin, and methylphenylsilicone resin; modified silicone resins thereof that is modified chemically with other organic resin; and the like.

Typical examples of the modified silicone resins include modified silicone resins that is modified with a fluorine resin, acrylic resin, epoxy resin, polyester resin, fluorine acrylic resin, acrylic-styrene resin, alkyd resin, urethane resin, or the like; cross-linkable fluorine-modified silicone resins; and the like. Preferable are straight silicone resins and fluorine-modified silicone resins; and more preferable are fluorine-modified silicone resins.

Examples of the straight silicone resins include those having the repeating unit represented by the following Formulae (II) or (III), and the like.

(II)

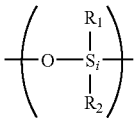

(III)

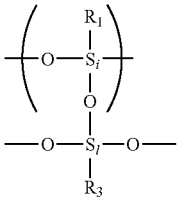

In the Formulae (II) and (III), $R_1$, $R_2$, and $R_3$ each independently represent a hydrogen or halogen atom, a hydroxy group, or an organic group such as methoxy, alkyl having 1 to 4 carbon atoms, or phenyl.

Examples of the fluorine-modified silicone resins include cross-linkable fluorine-modified silicone resins prepared by hydrolyzing an organic silicon compound containing a repeating unit represented by the Formula (II) or (III) and a perfluoroalkyl group, and the like. Examples of the perfluoroalkyl group-containing organic silicon compounds include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, $(CF_3)_2CF(CF_2)_8CH_2CH_2Si(OCH_3)_3$, and the like.

Typical examples of the conductive materials according to the present invention include metals such as gold, silver, and copper; carbon black; conductive metal oxide single substances such as titanium oxide and zinc oxide; composites obtained by coating fine particles such as of titanium oxide, zinc oxide, aluminum borate, potassium titanate, and tin oxide with a conductive metal oxide on the surface; and the like.

Carbon black is particularly preferable, from the viewpoints of productivity, cost, and low electric resistivity. The kind of carbon black is not particularly limited, but carbon black superior in production stability having a DBP (dibutyl phthanolate) adsorption amount in the range of 50 to 300 ml/100 g is favorable. The average particle size of the conductive powder is preferably 0.1 μm or less, and the primary particle size is preferably 50 nm or less, considering dispersion in resin. In addition, the specific surface area is preferably 700 $m^2/g$ or more, as the carbon black is higher in conductivity and gives a carrier having a sufficiently low resistivity even when added in a smaller amount; and the carbon black satisfying the requirements is most preferably Ketjen Black (manufactured by Lion).

Although the amount of the conductive material added depends on the kind of the conductive powder, the content of the conductive material in the innermost layer is preferably in the range of 0.04 to 0.6 parts by mass and more preferably 0.1 to 0.4 parts by mass with respect to 100 parts by mass of the entire carrier. A carrier containing it in an amount of less than 0.04 parts by mass has a higher electric resistivity and may not give an image with favorable density. A carrier containing it in an amount of more than 0.6 parts by mass has a lower electric resistivity and may cause increase of background soil by charge injection.

Alternatively, the content thereof in the outermost layer is preferably less than 0.025 parts by mass and more preferably in the range of 0.001 to 0.02 parts by mass with respect to 100 parts by mass of the entire carrier. A content of more than 0.025 parts by mass may lead to separation of the conductive material from the outermost layer. Alternatively, absence of the conductive material results in poor fluidity, which may prohibit adjustment of toner concentration by a magnetic permeability sensor.

The organic metal compound added as a metal catalyst for facilitating hardening of the silicone resin is not particularly limited, if it has an IP in the range above.

Specific examples of the organic metal compounds containing a metal having an ionization potential of less than 7 eV include aluminum propylate (Shinto Fine Co., Ltd.), calcium octylate (Shinto Fine Co., Ltd.), barium laurate (Shinto Fine Co., Ltd.), and the like.

Examples of the organic metal compounds containing a metal having an ionization potential of 7 eV or more include manganese naphthenate (Shinto Fine Co., Ltd.), dibutyltin dilaurate (Shinto Fine Co., Ltd.), cobalt octylate (Shinto Fine Co., Ltd.), zinc octylate (Shinto Fine Co., Ltd.), and the like.

The organic metal compound is preferably used in an amount in the range of 0.01 to 5 mass % in the resin forming the resin-coated layer.

The carrier according to the present invention can be prepared by coating resins containing the conductive material on a core material, by any one of known methods such as spray drying in fluidized bed, rotary drying, and immersion drying in a universal stirrer. Among these methods, spray drying in fluidized bed is recommended for increasing the coating areal rate on the carrier surface.

The carrier according to the present invention is preferably produced by coating the innermost layer by the spraying method of using a solution for forming a coated resin layer and the outermost layer by the liquid immersion method. Empirically, the spraying method gives a uniform coat, while the liquid immersion method an uneven coat more frequently. Thus, it is possible to form a uniform film by forming a resin-coated layer entirely by spray coating, but the conductive material carbon black is separated from the film more easily.

The liquid immersion method is a method of coating the carrier surface by dissolving the coat resin in a solvent, dispersing and agitating the core material therein, and removing the solvent under reduced pressure and/or heat.

For the purpose of the present invention, it is possible to suppress separation of carbon black while preserving the uniformity of the resin-coated layer to a certain extent, by using the spraying method allowing uniform coating in forming innermost layer for more uniformization and the liquid immersion method in forming the outermost layer. It is because it becomes possible to prevent separation of and contamination with carbon black during use of the carrier, for example, in printing machine, by dropping carbon black that is previously spray-coated on the surface of the carrier under agitating stress in a coating solution and hardening it with the coating resin, during coating of the outermost layer by the liquid immersion method.

The solvent for use in the solution for forming the coated resin layer is not particularly limited, if it dissolves the matrix resin described above, and examples thereof include aromatic hydrocarbons such as toluene and xylene, ketones such as acetone and methylethylketone, and ethers such as tetrahydrofuran and dioxane. A sand mill, Dynomill, homomixer, or the like may be used for dispersion of the resin fine particles and the conductive powder Both external and internal heating systems may be used for baking the core material after the resin is coating. For example, it may be baked in a fixed-bed or fluidized-bed electric furnace, rotary electric furnace or burner furnace, or by microwave oven. The baking temperature may vary according to the resin used, but should not be lower than the melting point or the glass transition point of the resin. For example, a thermosetting resin or a condensation cross-linkable resin should be heated to a temperature allowing sufficient progress of hardening. For example, a silicone resin is heated at a temperature of 200 to 300° C. for approximately 30 minutes.

In this way, the core material is coated with a resin on the surface, baked, cooled, pulverized, and classified, to give resin-coated carrier particles. In addition, stains and burrs on the coat film surface may be removed after pulverization, or carrier particles aggregated during coating may be pulverized once again in posttreatment for further homogeneity. The posttreatment method is not limited, if the carrier particles become under mechanical stress, and any one of the methods known in the art may be used. Examples thereof include, but are not limited to, Nauter mixer, ball mill, vibromill and the like.

The amount of the coating resin coated on the carrier core material surface is preferably in the range of 0.5 to 10 parts by mass and more preferably in the range of 0.5 to 7 parts by mass with respect to 100 parts by mass of the carrier. An amount of less than 0.05 parts by mass makes it difficult to form a uniform coating layer on the carrier surface, while an amount of more than 10.0 parts by mass results in excessive aggregation of the carrier particles.

Alternatively, the amount of the outermost layer coated is preferably in the range of 0.1 to 1 part by mass with respect to 100 parts by mass of the entire carrier. An amount of less than 0.1 part by mass may result in rapid loss of the outermost layer by abrasion and may eliminate the carbon black-holding effect, while an amount of more than 1 part by mass leads to increase in electric resistivity, which in turn may lead to production of an image unfavorable in density.

In the present invention, the resistivity of the carrier is preferably controlled into the range of $1\times10^3$ to $1\times10^{12}$ Ωcm and more preferably in the range of $1\times10^4$ to $1\times10^8$ Ωcm.

A carrier having a higher resistivity exceeding $1\times10^{12}$ Ωcm does not function well as a developing electrode during development, leading to deterioration in solid reproducibility, for example, generation of the edge effect especially in painted image areas. On the other hand, a carrier having a lower resistivity of less than $1\times10^3$ Ωcm often leads to injection of the charge on developing roll onto carrier when the toner concentration in the developer is lowered, consequently to the problem of destruction of the carrier itself.

In the carrier for electrostatic latent image developer according to the present invention thus prepared, carbon black is used preferably as the conductive material in the resin-coated layer; and the content of the carbon black in the resin-coated layer is preferably smaller in outer layer than in internal layer (in the outermost layer than in the innermost layer in the case of two layers). In this way, it is possible to adjust the carrier resistivity in the range above and reduce exfoliation more reliably.

<Electrostatic Latent Image Developer>

The carrier for electrostatic latent image developer according to the present invention gives an electrostatic latent image developer, as it is used together with any kind of particulate toner.

Any known binder resins, various colorants, or the like may be added in the toner of the invention. The primary component of such binder resins is preferably polyester resin or polyolefin resin, but copolymers of styrene and acrylic acid or methacrylic acid, polyvinyl chloride, phenol resins, acrylic resins, methacrylic resins, polyvinyl acetate, silicone resins, modified polyester resins, polyurethane, polyamide resins, furan resins, epoxy resins, xylene resins, polyvinyl butyral, terpene resins, coumarone indene resins, petroleum resins, polyether polyol resins and the like may be used alone or in combination of two or more. Use of a polyester resin or a norbornene polyolefin resin is preferable from the points of durability, light-transmitting property, and the like.

The glass transition temperature (Tg) of the binder resin for use in the toner is preferably in the range of 50 to 70° C.

The electrostatic latent image developer according to the present invention is preferably a developer for forming a full-color image, because the carrier for electrostatic latent image developer according to the present invention is resistant to the exfoliation of the conductive material on the surface as described above; and the toner is preferably one of a cyan toner, a magenta toner, or a yellow toner.

A colorant suitably selected according to the color of the toner may be used.

Examples of the colorants for the cyan toner include cyan pigments including C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, and 180; C.I. Vat Cyan 1, 3, and 20, iron blue, cobalt blue, alkali blue lake, phthalocyanine blue, nonmetal phthalocyanine blue, partially chlorinated phthalocyanine blue, Fast Sky Blue, and Indanthren Blue BC; and cyan dyes including C.I. Solvent Cyan 79 and 162; and the like. Among them, C.I. Pigment Blue 15:3 is effective.

Examples of the colorants for magenta toner include magenta pigment such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209, and Pigment Violet 19; magenta dyes such as C.I. Solvent Red 1, 3, 8, 23, 24, 25, 27, 30, 49, 81, 82, 83, 84, 100, 109, and 121, C.I. Disperse Red 9, C.I. Basic Red 1, 2, 9, 12, 13, 14, 15, 17, 18, 22, 23, 24, 27, 29, 32, 34, 35, 36, 37, 38, 39, and 40; Bengala, cadmium red, red lead, mercury sulfide, cadmium, Permanent Red 4R, Lithol Red, pyrazolone red, watching red, calcium salts, Lake Red D, Brilliant Carmine 6B, eosin lake, Rotamine Lake B, alizarin lake, Brilliant Carmine 3B, and the like.

Examples of the colorants for yellow toner include yellow pigments such as C.I. Pigment Yellow 2, 3, 15, 16, 17, 97, 180, 185, and 139; and the like.

Examples of the colorants for black toner include carbon black, activated carbon, titan black, magnetic powder, Mn-containing nonmagnetic powder, and the like.

The electrostatic latent image developer according to the present invention is also used favorably as a developer using an invisible toner for the same reason above. The invisible toner higher in transparency is prepared without use of the colorant above.

The invisible toner is a toner allowing image reading by using an invisible light such as infrared ray; and the toner may be visible or invisible when a toner image is fixed, for example, on paper. In other words, it is a toner to form an invisible image, for example in the infrared ray-absorbing pattern, such as bar code. A colorant in the amount at a level that presence of the colorant is unrecognizable, for example in an amount of 1% or less, is also included in the invisible toner. Accordingly, the configuration of the invisible toner is essentially the same as those of other color toners, except that the invisible toner contains no colorant. The invisible toner according to the present invention includes invisible toners which may be fixed by flash fusing.

The amount of each colorant added is preferably in the range of 1 to 20 parts by mass with respect to 100 parts by mass of the toner particles prepared as mixed with a binder resin and the like.

The color toner preferably contains an infrared absorbent when used as the toner for flash fusing described below. The infrared absorbent is a material having at least one or more strong light-absorbing peaks in the near-infrared region at the wavelength of 800 to 2,000 nm, and may be an organic or inorganic material.

Examples thereof include any known infrared absorbents, including cyanine compounds, merocyanine compounds, benzene thiol-based metal complexes, mercaptophenol-based metal complexes, aromatic diamine-based metal complexes, diimmonium compounds, aminium compounds, nickel complex compounds, phthalocyanine compounds, anthraquinone compounds, naphthalocyanine compounds, and the like.

More specific examples thereof include nickel metal complex-based infrared absorbents (trade name: SIR-130 and SIR-132, manufactured by Mitsui Chemicals), bis(dithiobenzyl)nickel (trade name: MIR-101, manufactured by Midori Kagaku Co. Ltd.), nickel bis(1,2bis(p-methoxy phenyl)-1,2-ethylenedithiolate) (trade name: MIR-102, manufactured by Midori Kagaku Co. Ltd.), tetra-n-butylammonium nickel bis (cis-1,2-diphenyl-1,2-ethylene dithiolate) (trade name: MIR-1011, manufactured by Midori Kagaku Co. Ltd.), tetra-n-butylammonium nickel bis(1,2bis(p-methoxyphenyl)-1,2-ethylenedithiolate) (trade name: MIR-1021, manufactured by Midori Kagaku Co. Ltd.), tetra-n-butyl ammonium nickel bis(4-tert-1, 2butyl-1,2-dithiophenolate) (trade name: BBDT-NI, manufactured by Sumitomo Seika Chemicals Co.), cyanine-based infrared absorbents (trade name: IRF-106 and IRF-107, manufactured by Fuji Photo Film Co. Ltd.), a cyanine-based infrared absorbent (trade name YKR2900, manufactured by Yamamoto Chemicals Inc.), aminium-based infrared absorbent and diimmonium-based infrared absorbent (trade name: NIR-AM1 and IM1, manufactured by Nagase ChemteX Corp.), immonium compounds (trade name: CIR-1080 and CIR-1081, manufactured by Japan Carlit Co.), aminium compounds (trade name: CIR-960 and CIR-961, prepared by Japan Carlit Co.), an anthraquinone compound (trade name: IR-750, manufactured by Nippon Kayaku), aminium compounds (trade name: IRG-002, IRG-003, and IRG003K, manufactured by Nippon Kayaku), a polymethine compound (trade name: IR820B, manufactured by Nippon Kayaku), diimmonium compounds (trade name: IRG-022 and IRG-023, manufactured by Nippon Kayaku), cyanin compounds (trade name: CY-2, CY-4, and CY-9, manufactured by Nippon Kayaku), a soluble phthalocyanine (trade name: TX-305A, manufactured by Nippon Shokubai Co., Ltd.), naphthalocyanines (trade name: YKR5010, manufactured by Yamamoto Chemicals Inc. and sample 1 manufactured by Sanyo Color Works Ltd.), inorganic materials (trade name: Ytterbium UU-HP, manufactured by Shin-Etsu Chemical and indium tin oxide, manufactured by Sumitomo Metal Industries, Ltd.), and the like.

Among these infrared absorbents, naphthalocyanine-, aminium-, and diimmonium-based infrared absorbents are preferable from the points of environmental safety and color tone. Dithiol-based nickel complexes are favorable in color tone, but higher in toxicity including carcinogenicity and thus most undesirable for addition to toner. In addition, cyanine colorants are also undesirable, because there are many materials shown to disturb hemopoietic functions and have a carcinogenic action by repeated administration to rats for 28 days. If a nickel complex or a cyanine is used, a material that can avoid these hazards is preferably selected.

Preferable as the infrared absorbent contained in the invisible toner are almost white ytterbium oxide, ytterbium phosphate, diimmonium, and naphthalocyanine-based and aminium-based infrared absorbents, from the points of environmental safety, color tone, and others.

These infrared absorbents may be used in combination of two or more. Such a combined use is more effective, as the infrared ray-absorbing region expands and thus the fixing property improves. The amount of the infrared absorbent added is preferably in the range of 0.01 to 5 parts by mass if it is an organic substance and in the range of 5 to 70 parts by mass if it is an inorganic substance, with respect to 100 parts by mass of toner particle. When the infrared absorbent is an organic substance, an amount of less than 0.01 part by mass may result in insufficient fixing of toner, while an amount of more than 5 parts by mass may result in a turbid color that cannot be practically used. Alternatively, when the infrared absorbent is an inorganic substance, the infrared absorbent is colored relatively faintly and thus may be used in a greater amount, but has a lower light absorption capacity, and should be added in a greater amount than that of an organic substance. An addition amount of less than 5 parts by mass may result in insufficient fixing of toner, while an addition amount of more than 50 parts by mass may also result in insufficient fixing of the toner due to decrease in the fixing efficiency of binder resin.

It is also preferable to lower the maximum absorbance of cyan toner in the light absorption range than the maximum absorbances of magenta and yellow toners for ensuring superiority both in fixing efficiency and void resistance, and from the viewpoint, it is preferable to reduce the amount of the infrared absorbent contained in the cyan toner to less than those in magenta and yellow toners. In addition, yellow toners are thinner in color and thus, more vulnerable to the influence by the color of infrared absorbent. For that reason, the total amounts of the infrared absorbent are preferably in the following order: (smaller) cyan<yellow<magenta (larger).

A charge control agent or a wax may be added as needed to each of the toners above.

A known quaternary ammonium salt may be used as the charge control agent, and another charge control agent such as calixarene, nigrosine dye, amino-group-containing polymer, metal-containing azo dye, salicylic acid complex compound, phenol compound, azo chromium compound, or azo zinc compound may be used in combination. In addition, the toners may be used as magnetic toners, as blended additionally with a magnetic material such as iron powder, magnetite, or ferrite. In particular, a known white magnetic powder may be used in color toners.

Examples of the waxes to be contained in the toner according to the present invention include ester waxes, polyethylene, polypropylene, or copolymers of polyethylene and polypropylene, polyglycerin waxes, microcrystalline waxes, paraffin waxes, carnauba wax, sazol wax, montanic acid ester waxes, deacidified carnauba waxes, unsaturated fatty acids such as palmitic acid, stearic acid, montanic acid, brassidic acid, eleostearic acid, and vernolic acid; saturated alcohols such as stearyl alcohol, aralkyl alcohol, behenyl alcohol, carnaubyl alcohol, ceryl alcohol, myricyl alcohol, and long-chain alkyl alcohols having a longer-chain alkyl group ; polyvalent alcohols such as sorbitol; fatty acid amides such as linolic amide, oleic amide, and lauric amide; saturated fatty acid bisamides such as methylene bisstearic amide, ethylene biscapric amide, ethylene bislauric amide, and hexamethylene bisstearic amide; unsaturated fatty acid amides such as ethylene bisoleic amide, hexamethylene bisoleic amide, N,N'-dioleyl-adipic amide, and N,N'-dioleyl-sebasic amide; aromatic acid bisamides such as m-xylene bisstearic amide, and N,N-distearyl-isophthalic amide; fatty acid metal salts (generally called metal soaps) such as calcium stearate, calcium laurate, zinc stearate, and magnesium stearate; aliphatic hydrocarbon waxes grafted with a vinyl monomer such as styrene or acryl acid; partially esterified compounds from a fatty acid and a polyvalent alcohol such as behenic acid monoglyceride; hydroxyl group-containing methyl ester compounds obtained by hydrogenation of vegetable oils; and the like. Ester waxes are preferable for improvement in fixing efficiency and reduction of voids.

The wax material for use in the toner preferably has an endothermic peak at a temperature of 50 to 110° C. as determined by differential calorimetric analysis (DSC analysis). The wax having an endothermic peak of lower than 50° C. may lead to blocking of the toner, while the wax of higher than 110° C. may lead to insufficient fixing. Use of an internally heating input-compensating differential scanning calorimeter higher in precision is preferable for the DSC analysis from the measuring principle.

In manufacturing the toner of the invention, a generally used kneading pulverizing method, a wet granulation method or the like can be conducted.

Examples of the wet granulation method include a suspension polymerization method, an emulsion polymerization method, an emulsion polymerization aggregation method, a soap-free emulsion polymerization method, a non-aqueous dispersion polymerization method, an in-situ polymerization method, an interfacial polymerization method, and an emulsion dispersion granulation method.

In the kneading pulverizing method above, for example, the toners can be prepared as follows. A binder resin, wax, a charge control agent, a pigment or a dye as a colorant, a magnetic substance, an infrared absorbent, and any other additive are sufficiently mixed with each other with a mixer such as a HENSCHEL mixer or a ball mill. Then, the mixture is melted and kneaded with a heat kneader such as a heating roll, a kneader, or an extruder. As a result, the metal compound, dye, and magnetic substance are dispersed or dissolved in the resultant sufficiently mixed and melted resin. The resultant is cooled down and solidified, and then pulverized and classified to prepare a toner. The pigment or infrared absorbent may be used in the form of masterbatch.

Further, the infrared absorbent may be adhered or fixed onto the surface of the color toner or the invisible toner instead of being added by dispersing in the color toner and invisible toner as described above.

Examples of the surface modification devices used for facilitating the surface adherence include surface modification devices wherein the toners are subjected to impact in a high-speed air flow such as Surfusing System (manufactured by Nippon Pneumatic Mfg. Co.), hybridization system (manufactured by Nara Machinery Co.), Kryptron Cosmo series products (manufactured by Kawasaki Heavy Industries), and surface modification devices whereto dry mechanomill method is applied such as Innomizer System (manufactured by Hosokawamicron), Mechanofusion System (manufactured by Hosokawamicron), and Mechanomill (manufactured by Okada Seiko Co.); surface modification device whereto a wet coating is applied such as Dispercoat (manufactured by Nissin Engineering) and Coatmizer (manufactured by Freund Co., Ltd.); and the like, and these devices may be used in combination as needed.

The toner prepared as described above preferably has a volume average particle size D50v of 3 to 10 μm, and more preferably 4 to 8 μm. The ratio of the volume average particle size D50v to a number average particle size D50p (D50v/D50p) is preferably in the range of 1.0 to 1.25. By using toner particles having a small and uniform size as described above, unevenness of the charging property of the toner is prevented. Thereby, fogging in the resulting images can be suppressed, and the fixing property of the toner is also improved. Moreover, reproducibility of narrow lines and dots in the resulting images can also be improved.

The toner has an average degree of roundness of 0.955 or more, and more preferably 0.960 or more. Moreover, the toner of the invention preferably has standard deviation of degree of roundness of 0.040 or less, and more preferably 0.038 or less. When the toner of the invention has such an average degree of roundness and standard deviation of degree of roundness, toner particles can be densely overlaid on a recording medium, and the resultant toner layer on the recording medium can be therefore thin, resulting in improved fixation. As described, by making the toner shape uniform, fogging in the resulting images can be suppressed, and reproducibility of narrow lines and dots can be improved.

The average degree of roundness (circular perimeter/actual perimeter) is calculated after determining the perimeter of the projected image of a particle in an aqueous dispersion system and the circumferential length (circular perimeter) of a circle having an identical area to the projected area of the toner particle by using a flow-type particle image analyzer (trade name: FPIA2000, manufactured by Sysmex Corp.).

The volume average particle size distribution index GSDv of the toner particle is preferably 1.25 or less.

The volume-average particle size, the particle size distribution indicator, and the like of the toner of the invention can be determined by using COULTER COUNTER TAII (manufactured by Beckmann-Coulter Inc.), and ISOTON-II (manufactured by Beckmann-Coulter) as the electrolyte.

Based on the particle size distribution thus determined, the volume and the number of toner particles in each of the particle size range (channel) previously partitioned are obtained and plotted from the smallest side, to give a cumulative distribution curve; and the particle sizes at a cumulative point of 16% are designated respectively as volume-average particle size D16v and number-average particle size D16p; and those at a cumulative point of 50%, as volume-average particle size D50 (representing the volume-average particle size of the toner described above) and the number-average particle size D50 p. In the similar manner, the particle size at a cumulative point of 84% were designated respectively as volume-average particle size D84v and the number-average particle size D84p. The volume-verage particle distribution index (GSDv) is calculated as a square root of 84v/D16v by using the values above.

White inorganic fine particles may be added to the toner of the invention for improvement in flowability and the like. The mixing ratio of the inorganic fine particles in the toner particles is preferably in the range of 0.01 to 5 parts by mass and more preferably in the range of 0.01 to 2.0 parts by mass with respect to 100 parts by mass of the toner particles. Examples of the inorganic fine particles include silica fine powder, alumina, titanium oxide, barium titanate, magnesium titanate, calcium titanate, strontium titanate, zinc oxide, quartz sand, clay, mica, wollastonite, diatomaceous earth, chromium oxide, cerium oxide, bengala, antimony trioxide, magnesium oxide, zirconium oxide, barium sulfate, barium carbonate, calcium carbonate, silicon carbide, silicon nitride, and the like, and silica fine powder is particularly preferable. In addition, any other known materials such as silica, titanium, resin fine powders, alumina, and the like may be used additionally. Further, a metal salt of a higher fatty acid represented by zinc stearate or fine particle powders of a fluorochemical polymer may be added thereto as a cleaning activator.

The toner according to the invention can be prepared by mixing the inorganic fine particles above and desired additives as needed sufficiently in a mixer such as a HENSCHEL mixer or the like.

The electrostatic latent image developer according to the present invention contains a toner preferably in an amount adjusted in the range of 2 to 15 parts by mass with respect to 100 parts by mass of the carrier for electrostatic latent image developer according to the present invention described above.

The image-forming process by using the electrostatic latent image developer according to the present invention is not particularly limited, as long as a full color toner image or an invisible toner image can be formed on a recording medium by using toners including color toners, and specifically, preferable is the following image-forming process in the electrophotographic process:

The image-forming process includes, for example, a step of forming an electrostatic charged image on an electrostatic latent image-holding member surface, a step of forming a toner image by developing the electrostatic charged image formed on the electrostatic latent image-holding member surface with a developer including toner, a step of transferring the toner image formed on the electrostatic latent image-holding member surface onto an image-receiving member surface, and a fixing step of forming an image on the recording medium surface by fixing the toner image transferred on the recording medium surface. The developer according to the present invention containing a color toner or an invisible toner described above is used as the developer in the process.

Each of the steps described above may be performed by any one of known methods practiced in the conventional image-forming processes. When no intermediate transfer body is used, the image-receiving member represents a recording medium as it is. In addition, the image-forming process may include additionally steps other than those above, for example, a cleaning step of cleaning the latent image-holding member surface.

When an electrophotographic photoreceptor is used as the electrostatic latent image-holding member, an image is formed in the image-forming process, for example, as follows: First, the surface of an electrophotographic photoreceptor is charged uniformly, for example by a Corotron charger or a contact charger, and exposed to light, giving an electrostatic charged image. Then, a toner image is formed on the electrophotographic photoreceptor, by bringing the surface into contact with a developing roll having a developer layer formed and thus depositing toner particle on the electrostatic charged image. The formed toner image is transferred onto the surface of an image-receiving member such as paper by using, for example, a Corotron charger. The toner image transferred on a recording medium surface is then fixed in a fixing unit, to give an image on the recording medium.

An inorganic photoreceptor such as amorphous silicon or selenium or an organic photoreceptor such as polysilane or phthalocyanine is generally used as the charge-generating material or the charge-transporting material of the electrophotographic photoreceptor, and in particular, an amorphous silicon photoreceptor is preferable because it has a longer life.

The fixing unit is not limited, and may be a flash fusing unit, oven-fixing unit, heat roll-fixing unit, or the like.

The image-forming method of the invention can be applied to a high-speed process, since images are fixed by flash fusing. The processing speed in the process according to the invention is preferably 600 mm/sec or more, and more preferably, 1,000 mm/sec or more.

Examples of the light sources for use in the flash fusing include common halogen lamps, mercury lamps, flash lamps, infrared lasers, and the like. Among them, a flash lamp is most preferable, because the flash lamp can instantaneously fix toner images and save energy. The emitted light energy of the flash lamp is preferably in the range of 1.0 to 7.0 J/cm$^2$ and more preferably in the range of 2 to 5 J/cm$^2$.

Here, the energy of flash received per unit area, which indicates intensity of xenon lamp, is expressed by the following equation (2).

$$S=((1/2)\times C\times V^2)/(u\times L)\times(n\times f) \quad \text{Equation (2)}$$

In the equatation (2), n represents the number of lamps flashing at once; f represents a flash Frequency (Hz); V represents an input voltage(V); C represents a condenser capacity (F); u represents a process conveying speed (cm/s); L represents the effective flash width of flash lamp (generally maximum paper width (cm)); and S represents an energy density (J/cm$^2$).

The flash fusing method in the invention is preferably a delay method in which the plurality of flash lamps emit light at a time interval. In this delay method, flash lamps are arranged, and these lamps are turned on one by one at time intervals in the range of 0.01 to 100 miliseconds, and the same portion of an image is irradiated plural times. In this method, in order to provide the toner image with necessary light energy, the toner image is irradiated plural times rather than being irradiated only once. Therefore, light energy per flashing can be lower in this method than in a fixing method in which light energy is supplied only once. Thereby, the delay method can achieve both void suppression and improved fixing property.

As described above, in a case where a toner image is irradiated plural times, the emitted light energy of the plural flash lamps is the sum of emitted light energy applied to a unit area per flashing.

In the invention, the number of flash lamps is preferably 1 to 20, and more preferably 2 to 10. The time interval from one lamp's flashing to the next lamp's flashing is preferably in the range of 0.1 to 20 miliseconds, and more preferably in the range of 1 to 3 miliseconds.

Moreover, the emitted light energy of a flash lamp per flashing is preferably in the range of 0.1 to 1 J/cm$^2$, and more preferably in the range of 0.4 to 0.8 J/cm$^2$.

<Image-Forming Device>

Hereinafter, an example of the image-forming device according to the present invention equipped with a flash fusing unit wherein the carrier for electrostatic latent image developer according to the present invention and the electrostatic latent image developer using the same are used will be described with reference to drawings. FIG. 1 is a schematic view illustrating an example of the image-forming device. In the image-forming device of FIG. 1, a toner image is formed with toners in three colors of cyan, magenta, and yellow as well as a black toner.

In FIG. 1, 1*a* to 1*d* each represent an electrification means; 2*a* to 2*d*, a light-exposure means; 3*a* to 3*d*, an electrostatic charged image-holding member (photoreceptor); 4*a* to 4*d* a developing means; 10, a recording paper (recording medium)

fed from a roll medium 15 in the direction indicated by an arrow; 20, a cyan developing unit; 30, a magenta developing unit; 40, an yellow developing unit; 50, a black developing unit; 70*a* to 70*d*, a transfer means (transfer roller); 71 and 72, a roller; 80, a transfer voltage-supplying means; and 90, a flash fusing unit.

The image-forming device shown in FIG. 1 includes developing units (toner image-forming units) in various colors indicated by numbers 20, 30, 40, and 50 each including an electrification means, a light-exposure means, a photoreceptor, and a developing means; rollers 71 and 72 in contact with a recording paper 10 that convey the recording paper 10; transfer rolls 70*a*, 70*b*, 70*c*, and 70*d* pressing the photoreceptors placed on the side of the recording paper 10 opposite to the photoreceptors in respective developing units; a transfer voltage-supplying means 80 of supplying voltage to these four transfer rolls; and a flash fusing unit (fixing unit) 90 of irradiating light on the photoreceptor-side surface of a recording paper 10 traveling in the direction indicated by the arrow in the Fig. through the nip regions between the photoreceptors and the transfer rolls.

The cyan developing unit 20 includes an electrification means 1*a*, a light-exposure means 2*a*, and a developing means 4*a*, clockwise along the periphery of the photoreceptor 3*a*. In addition, a transfer roll 70*a* is placed at a position, via a recording paper 10, in contact with the photoreceptor 3*a* surface in the area clockwise from the position of the developing means 4*a* of photoreceptor 3*a* to that of the electrification means 1*a*. The configuration is the same also in other color developing units. In the image-forming device according to the present invention, the cyan developer including toner is stored in the developing means 4*a* of the cyan developing unit 20, and toners for flash fusing in different color are held respectively in the developing means of other developing units.

Hereinafter, image forming by using the image-forming device will be described. First in the black developing unit 50, the surface of the photoreceptor 3*d* is charged uniformly by an electrification means 1*d* while the photoreceptor 3*d* is rotated clockwise. Then, a latent image corresponding to the black component of the original image to be reproduced is formed on the surface of the photoreceptor 3*d*, by exposing the surface of the charged photoreceptor 3*d* to the light from the light-exposure means 2*d*. The latent image is then developed with the black toner stored in the developing means 4*d*, into a black toner image. The operation is repeated in the yellow developing unit 40, magenta developing unit 30, and cyan developing unit 20, giving respectively, toner images in respective colors on the photoreceptor surface of the developing units.

The toner images formed on photoreceptor surfaces in various colors are transferred one by one onto the recording paper 10 traveling in the direction indicated by an arrow by the action of transfer electric potentials by the transfer rolls 70*a* to 70 d, and piled on the surface of the recording paper 10 in a manner reproducing the original image information, giving a full-color layered toner image of cyan, magenta and yellow in color from the top layer.

The layered toner image formed on the recording paper 10 is then conveyed to the position of flash fusing unit 90, where it is fused and fixed on the recording paper 10 by photoirradiation, giving a full-color image.

In an embodiment of the image-forming device of the invention, the processing speed is preferably 600 mm/sec or more, and more preferably, 1,000 mm/sec or more. In an embodiment of the image-forming device of the invention, the light source for the flash fusing is a flash lamp, and the emitted light energy of the flash lamp is in a range of from 1.0 to 7.0 J/cm. In an embodiment of the image-forming device of the invention, the fixing unit includes a plurality of flash lamps and performs delayed flash fusing using the plurality of flash lamps which emit light at a time interval.

EXAMPLES

Hereinafter, the present invention will be described specifically with reference to Examples. In the following description, "part" and "%" mean "part by mass" and "mass %" respectively, unless specified otherwise, <Preparation of Carrier>

(Carrier Core (Core Material))

Taw materials are blended in amounts of 20 mol % as MnO and 80 mol % as $Fe_2O_3$, and a small amount of $SiO_2$ is added thereto for control of the surface shape of the ferrite core. After addition of water, the mixture is pulverized and blended in a wet ball mill for 10 hours, dried, and kept at 950° C. for 4 hours, and then, pulverized in a wet ball mill for 24 hours. The slurry thus obtained is granulated and sintered at 1,300° C. in a nitrogen environment for 6 hours, pulverized, classified, to give manganese ferrite particles (core material). The volume average particle size of the manganese ferrite particles is 40 μm, and the magnetic susceptibility thereof at an applied magnetic field of 3,000 oersteds is 95 emu/g.

Carrier cores Nos. 1 to 5 having the compositions shown in Table 1 are prepared by adjusting the amount of $SiO_2$ added. The chemical compositions shown in Table 1 are determined by fluorescent X-ray analysis as follows:

-Apparatuses used for Analysis-

The fluorescent X-ray analyzer used is ZSX100e manufactured by Rigaku Denki Kogyo Co., Ltd.

-Analytical Method-

1) Approximately 18 g of a sample is collected and placed on an iron test-piece stage having a diameter of 40 mm and adhered thereto under a pressure of 20 t.

2) The sample is subjected to qualitative elemental analysis by a fluorescent X-ray analyzer. The measuring conditions are as follows:

X-Ray Irradiation Diameter: 30 mm

Measuring conditions (elements analyzed/dispersive crystal, detector attenuator, slit Rh tube accelerating voltage, and current, in that order)

B: RX60/PC (1/1), Ultra, 30 kV, 80 mA

C: RX60/PC (1/1), Ultra, 30 kV, 80 mA

N: RX40/PC (1/1), Ultra, 30 kV, 80 mA

O: RX40/PC (1/1), STD, 30 kV, 80 mA

F, Na, and Mg: TAP/SC (1/1), STD, 30 kV, 80 mA

Al and Si: PET/PC (1/1), STD, 30 kV, 80 mA

P, S: Ge/PC (1/1), STD, 30 kV, 80 mA

Cl: Ge/PC (1/1), Fine, 30 kV, 80 mA

K and Ca: LiF/PC (1/1), STD, 40 kV, 60 mA

Ti to U: LiF/SC (1/1), STD, 50 kV, 48 mA

Quantitative determination method: SFP (Semi-Fundamental Parameter Procedure: An analytical method of determining the amount of each element, by comparing a measured intensity, as determined based on the coefficient inherent to the analyzer, to the theoretical intensity of each element, and a means effective for qualitative analysis, as it gives an approximate composition without need for a calibration curve formed with standard samples.)

TABLE 1

| Component | Composition (%) of core material | | | | |
|---|---|---|---|---|---|
| | Core No. 1 | Core No. 2 | Core No. 3 | Core No. 4 | Core No. 5 |
| F | — | — | — | — | — |
| MgO | Less than 0.05 | Less than 0.05 | Less than 0.05 | Less than 0.05 | Less than 0.05 |
| $Al_2O_3$ | 0.08 | 0.09 | 0.06 | 0.08 | 0.09 |
| $SiO_2$ | 0.05 | 0.11 | 0.25 | 0.44 | 0.56 |
| $P_2O_5$ | Less than 0.05 | Less than 0.05 | Less than 0.05 | Less than 0.05 | Less than 0.05 |
| $SO_3$ | — | Less than 0.05 | — | — | Less than 0.05 |
| Cl | Less than 0.05 | — | — | Less than 0.05 | — |
| CaO | Less than 0.05 | Less than 0.05 | Less than 0.05 | Less than 0.05 | Less than 0.05 |
| $TiO_2$ | Less than 0.05 | Less than 0.05 | Less than 0.05 | Less than 0.05 | Less than 0.05 |
| $V_2O_5$ | Less than 0.05 | — | Less than 0.05 | Less than 0.05 | — |
| $Cr_2O_3$ | 0.07 | 0.06 | 0.08 | 0.07 | 0.06 |
| MnO | 11 | 11 | 11 | 11 | 11 |
| $Fe_2O_3$ | 88 | 88 | 88 | 87 | 87 |
| $Co_2O_3$ | Less than 0.05 | Less than 0.05 | Less than 0.05 | Less than 0.05 | Less than 0.05 |
| NiO | 0.18 | 0.19 | 0.08 | 0.18 | 0.19 |
| CuO | 0.45 | 0.58 | 0.41 | 0.45 | 0.58 |
| ZnO | 0.45 | 0.71 | 0.41 | 0.45 | 0.71 |
| $Ga_2O_3$ | Less than 0.05 | Less than 0.05 | Less than 0.05 | Less than 0.05 | Less than 0.05 |
| SrO | Less than 0.05 | Less than 0.05 | Less than 0.05 | Less than 0.05 | Less than 0.05 |
| $Nb_2O_5$ | Less than 0.05 | Less than 0.05 | Less than 0.05 | Less than 0.05 | Less than 0.05 |
| $MoO_3$ | Less than 0.05 | Less than 0.05 | Less than 0.05 | Less than 0.05 | Less than 0.05 |

(Carrier 1)

As shown in Table 2, a cross-linkable fluorine-modified silicone resin containing a trifluoropropyl group at 15% is weighed in an amount of 200 g as solid mater and dissolved in 1,000 cc of toluene solvent; conductive carbon black (Ketjen black EC600JD, manufactured by Lion, BET specific surface area: 1,270 $m^2/g$) is added in an amount of 15% with respect to the resin solid matter; and the mixture is dispersed in a pearl mill.

9.768 kg of the manganese ferrite particles are coated with the coating resin solution above (solution for forming a resin-coated layer) containing dispersed carbon black in a fluidized-bed (spray-dry) coating machine, by supplying the solution over a period of 1 hour while adjusting the spraying amount per unit time. Then, the particles are baked at 270° C. for 1 hour, pulverized, and posttreated in a vibration mill for 30 minutes, to give a carrier 1. The measured volume average particle size of the carrier 1 is 40 μm. The compositions of the core and the resin-coated layer are shown in Table 2.

(Carriers 2 to 15)

A cross-linkable fluorine-modified silicone resin containing a trifluoropropyl group at 15% is weighed in an amount of 200 g as solid matter and dissolved in 1,000 cc of toluene solvent; conductive carbon black (Ketjen black EC600JD, manufactured by Lion, BET specific surface area: 1,270 $m^2/g$) is added in an amount of 15% with respect to the resin solid matter; each of the additive resin solid matters shown in Table 2 is added in an amount of 1% with respect to the resin solid matter; and the mixture is dispersed in a pearl mill.

The manganese ferrite particles are coated with the coating resin solution (solution for forming a resin-coated layer) containing dispersed carbon black in a fluidized bed (spray dry) coating machine, by supplying the solution over a period of 1 hour while adjusting the spraying amount per unit time. Then, a surface-side coat layer is formed by the liquid immersion method, i.e., by using a universal stirrer as coating machine and each of the solutions for forming the outermost layer shown respectively in Table 2 while agitating the mixture at 60° C. under reduced pressure.

The powder is then baked at 270° C. for 1 hour, pulverized, and posttreated in a vibration mill for 30 minutes, to give each of carriers 2 to 15. The measured volume average particle size of each of the carrier 2 to 15 is 40 μm. The compositions of the respective carrier cores and resin-coated layers are summarized in Table 2.

(Carriers 16 to 22)

Carriers 16 to 22 are prepared in a similar manner to the carrier 5, except that the amounts of carbon black added to the innermost and outermost layers are changed to those shown in Table 2.

The measured volume average particle size of each of the carriers 16 to 22 is 40 μm. The composition of the respective carrier cores and resin-coated layers are summarized in Table 2.

(Carriers 23 to 26)

Carriers 23 to 26 are prepared in a similar manner to the carrier 5, except that core No. 1, 2, 4, or 5 is used instead of core No. 3 as the core material.

The measured volume average particle size of each of the carriers 23 to 26 is 40 μm. The compositions of the respective carrier cores and resin-coated layers are summarized in Table 2.

(Carriers 27 to 28)

Carriers 27 to 28 are prepared in a similar manner to the carrier 5, except that the methods of coating the innermost and outermost layers are changed to those shown in Table 2.

The measured volume average particle size of each of the carriers 22 to 28 is 40 μm. The compositions of the respective carrier cores and resin-coated layers are summarized in Table 2. In addition, the kind of each of the organic metal compound additives 1 to 7, the metal contained therein, and the IP thereof are summarized in Table 3.

TABLE 2

| | Core material | | Innermost layer | | | | | Outermost layer | |
|---|---|---|---|---|---|---|---|---|---|
| | Kind | Mass ratio (part) | Silicone resin (part) | Carbon (part) | Additive 1 | Additive 3 | Coating method | Silicone resin (part) | Carbon (part) |
| Carrier 1 | No. 3 | 97.68 | 2 | 0.30 | 0.02 | 0 | Spraying method | — | — |
| Carrier 2 | No. 3 | 97.18 | 2 | 0.30 | 0.02 | 0 | Spraying method | 0.5 | 0.0005 |
| Carrier 3 | No. 3 | 97.18 | 2 | 0.30 | 0.02 | 0 | Spraying method | 0.5 | 0.0005 |
| Carrier 4 | No. 3 | 97.18 | 2 | 0.30 | 0.02 | 0 | Spraying method | 0.5 | 0.0005 |
| Carrier 5 | No. 3 | 97.18 | 2 | 0.30 | 0.02 | 0 | Spraying method | 0.5 | 0.0005 |
| Carrier 6 | No. 3 | 97.18 | 2 | 0.30 | 0.02 | 0 | Spraying method | 0.5 | 0.0005 |

TABLE 2-continued

| | | | | | | | | | |
|---|---|---|---|---|---|---|---|---|---|
| Carrier 7 | No. 3 | 97.18 | 2 | 0.30 | 0.02 | 0 | Spraying method | 0.5 | 0.0005 |
| Carrier 8 | No. 3 | 97.18 | 2 | 0.30 | 0.02 | 0 | Spraying method | 0.5 | 0.0005 |
| Carrier 9 | No. 3 | 97.18 | 2 | 0.30 | 0.02 | 0 | Spraying method | 0.5 | 0.0005 |
| Carrier 10 | No. 3 | 97.18 | 2 | 0.30 | 0 | 0.02 | Spraying method | 0.5 | 0.0005 |
| Carrier 11 | No. 3 | 97.66 | 2 | 0.30 | 0.02 | 0 | Spraying method | 0.02 | 0.0005 |
| Carrier 12 | No. 3 | 97.38 | 2 | 0.30 | 0.02 | 0 | Spraying method | 0.3 | 0.0005 |
| Carrier 13 | No. 3 | 96.98 | 2 | 0.30 | 0.02 | 0 | Spraying method | 0.7 | 0.0005 |
| Carrier 14 | No. 3 | 96.68 | 2 | 0.30 | 0.02 | 0 | Spraying method | 1 | 0.0005 |
| Carrier 15 | No. 3 | 96.18 | 2 | 0.30 | 0.02 | 0 | Spraying method | 1.5 | 0.0005 |
| Carrier 16 | No. 3 | 97.44 | 2 | 0.04 | 0.02 | 0 | Spraying method | 0.5 | 0.0005 |
| Carrier 17 | No. 3 | 97.28 | 2 | 0.20 | 0.02 | 0 | Spraying method | 0.5 | 0.0005 |
| Carrier 18 | No. 3 | 96.88 | 2 | 0.60 | 0.02 | 0 | Spraying method | 0.5 | 0.0005 |
| Carrier 19 | No. 3 | 96.48 | 2 | 1.00 | 0.02 | 0 | Spraying method | 0.5 | 0.0005 |
| Carrier 20 | No. 3 | 97.18 | 2 | 0.30 | 0.02 | 0 | Spraying method | 0.5 | 0 |
| Carrier 21 | No. 3 | 97.17 | 2 | 0.30 | 0.02 | 0 | Spraying method | 0.5 | 0.01 |
| Carrier 22 | No. 3 | 97.15 | 2 | 0.30 | 0.02 | 0 | Spraying method | 0.5 | 0.025 |
| Carrier 23 | No. 1 | 97.18 | 2 | 0.30 | 0.02 | 0 | Spraying method | 0.5 | 0.0005 |
| Carrier 24 | No. 2 | 97.18 | 2 | 0.30 | 0.02 | 0 | Spraying method | 0.5 | 0.0005 |
| Carrier 25 | No. 4 | 97.18 | 2 | 0.30 | 0.02 | 0 | Spraying method | 0.5 | 0.0005 |
| Carrier 26 | No. 5 | 97.18 | 2 | 0.30 | 0.02 | 0 | Spraying method | 0.5 | 0.0005 |
| Carrier 27 | No. 3 | 97.18 | 2 | 0.30 | 0.02 | 0 | Spraying method | 0.5 | 0.0005 |
| Carrier 28 | No. 3 | 97.18 | 2 | 0.30 | 0.02 | 0 | Liquid immersion method | 0.5 | 0.0005 |

| | Outermost layer | | | | | | | |
|---|---|---|---|---|---|---|---|---|
| | Additive 1 | Additive 2 | Additive 3 | Additive 4 | Additive 5 | Additive 6 | Additive 7 | Coating method |
| Carrier 1 | — | — | — | — | — | — | — | Liquid immersion method |
| Carrier 2 | 0 | 0 | 0 | 0 | 0 | 0 | 0 | Liquid immersion method |
| Carrier 3 | 0.001 | 0 | 0 | 0 | 0 | 0 | 0 | Liquid immersion method |
| Carrier 4 | 0 | 0.001 | 0 | 0 | 0 | 0 | 0 | Liquid immersion method |
| Carrier 5 | 0 | 0 | 0.001 | 0 | 0 | 0 | 0 | Liquid immersion method |
| Carrier 6 | 0 | 0 | 0 | 0.001 | 0 | 0 | 0 | Liquid immersion method |
| Carrier 7 | 0 | 0 | 0 | 0 | 0.001 | 0 | 0 | Liquid immersion method |
| Carrier 8 | 0 | 0 | 0 | 0 | 0 | 0.001 | 0 | Liquid immersion method |
| Carrier 9 | 0 | 0 | 0 | 0 | 0 | 0 | 0.001 | Liquid immersion method |
| Carrier 10 | 0.001 | 0 | 0 | 0 | 0 | 0 | 0 | Liquid immersion method |
| Carrier 11 | 0 | 0 | 0.001 | 0 | 0 | 0 | 0 | Liquid immersion method |
| Carrier 12 | 0 | 0 | 0.001 | 0 | 0 | 0 | 0 | Liquid immersion method |
| Carrier 13 | 0 | 0 | 0.001 | 0 | 0 | 0 | 0 | Liquid immersion method |
| Carrier 14 | 0 | 0 | 0.001 | 0 | 0 | 0 | 0 | Liquid immersion method |
| Carrier 15 | 0 | 0 | 0.001 | 0 | 0 | 0 | 0 | Liquid immersion method |
| Carrier 16 | 0 | 0 | 0.001 | 0 | 0 | 0 | 0 | Liquid immersion method |
| Carrier 17 | 0 | 0 | 0.001 | 0 | 0 | 0 | 0 | Liquid immersion method |
| Carrier 18 | 0 | 0 | 0.001 | 0 | 0 | 0 | 0 | Liquid immersion method |
| Carrier 19 | 0 | 0 | 0.001 | 0 | 0 | 0 | 0 | Liquid immersion method |
| Carrier 20 | 0 | 0 | 0.001 | 0 | 0 | 0 | 0 | Liquid immersion method |
| Carrier 21 | 0 | 0 | 0.001 | 0 | 0 | 0 | 0 | Liquid immersion method |
| Carrier 22 | 0 | 0 | 0.001 | 0 | 0 | 0 | 0 | Liquid immersion method |
| Carrier 23 | 0 | 0 | 0.001 | 0 | 0 | 0 | 0 | Liquid immersion method |
| Carrier 24 | 0 | 0 | 0.001 | 0 | 0 | 0 | 0 | Liquid immersion method |
| Carrier 25 | 0 | 0 | 0.001 | 0 | 0 | 0 | 0 | Liquid immersion method |

TABLE 2-continued

| | | | | | | | | |
|---|---|---|---|---|---|---|---|---|
| Carrier 26 | 0 | 0 | 0.001 | 0 | 0 | 0 | 0 | Liquid immersion method |
| Carrier 27 | 0 | 0 | 0.001 | 0 | 0 | 0 | 0 | Spraying method |
| Carrier 28 | 0 | 0 | 0.001 | 0 | 0 | 0 | 0 | Spraying method |

Conductive substance: carbon black (trade name: EC600JD (manufactured by Lion)) Silicone resin: cross-linkable straight silicone (trade name: SR2411 (Dow Corning Toray Co., Ltd.))

TABLE 3

| Additive | Description | IP of metal (eV) |
|---|---|---|
| Additive 1 | Aluminum propylate (Shinto Fine Co., Ltd.) | 5.986 |
| Additive 2 | Manganese naphthenate (Shinto Fine Co., Ltd.) | 7.435 |
| Additive 3 | Dibutyltin dilaurate (Shinto Fine Co., Ltd.) | 7.344 |
| Additive 4 | Cobalt octylate (Shinto Fine Co., Ltd.) | 7.86 |
| Additive 5 | Zinc octylate (Shinto Fine Co., Ltd.) | 9.394 |
| Additive 6 | Calcium octylate (Shinto Fine Co., Ltd.) | 6.133 |
| Additive 7 | Barium laurate (Shinto Fine Co., Ltd.) | 5.212 |

<Preparation of Toner>

Each of the toner composition shown in Table 4 containing a binder resin, an infrared absorbent, a pigment, an charge control agent, and a wax is placed and roughly mixed in a HENSCHEL mixer, melt-blended in an extruder (manufactured by Ikegai Co. Ltd., PCM-30) at 135° C. and 250 rpm, pulverized in a hammer mill into coarse particles, further pulverized in a jet mill into fine particles, and classified in an air classifier, to give toner particles having a volume average particle size of 6.1 to 6.5 μm.

Then, hydrophobic silica fine particles, resin particles, and titanium oxide are added in amounts respectively of 0.5 parts to 100 parts of the toner particles, and the mixture is externally treated in a HENSCHEL mixer, to give each of the toners (ST-1 to ST-4) shown in Table 4.

Magenta pigment: C.I. Pigment Vioret19, trade name: RED E2B 70 (Clariant)

Cyan pigment: C.I. Pigment Blue15:3, trade name: blue No. 4 (Dainichiseika Color & Chemicals Mfg.)

Yellow pigment: C.I. Pigment Yellow, trade name: Paliotol Y-D1155(BASF)

Infrared absorbent: diimmonium, trade name: NIR-IM 1 (Nagase Chemtex)

Fixing aid: ester wax, trade name: WEP-5F (NOF Corporation)

Binder resin: cycloolefin resin, trade name: TOPAS (Ticona)

Charge Controling agent: quaternary ammonium salt, trade name: P-51 (Orient Chemical Industries)

Wax: polyethylene, trade name: Ceridust 2051 (Clariant)

External additive: silica, trade name: TG820F

Resin particle: polymethyl methacrylate fine particles, trade name: NP1451 (Soken Chemical & Engineering)

Titanium oxide: trade name: NKT90 (Nippon Aerosil)

Six parts by mass of the yellow toner is added to 94 parts of each of the carriers 1 to 28 thus prepared, and the mixture is blended in a 10-L ball mill for 2 hours, to give 7 kg of each of 28 two-component developers.

Two-component developers are prepared from carrier 5 and the magenta, cyan, and invisible toners in a similar manner to above; the monochrome toner currently used in DOCUPRINT 1100CF manufactured by Fuji Xerox Co., Ltd. is made available; and thus, a set of developers of yellow, cyan, magenta, invisible, and monochrome toners is prepared.

Examples 1 to 22 and Comparative Examples 1 to 6

An image prepared by using each of the yellow developers after durability test is evaluated. The apparatus used for evalu-

TABLE 4

| | | Infrared absorbent added (wt %) | Fixing aid added (wt %) | Binder resin added (part) | Charge control agent (part) | Wax (part) | Pigment (part) Cyan pigment | Magenta pigment | Yellow pigment | External additive (part) Silica | Resin particle | Titanium oxide |
|---|---|---|---|---|---|---|---|---|---|---|---|---|
| Cyan toner | ST-1 | 0.4 | 5 | 88.5 | 1 | 1 | 3 | — | — | 0.5 | 0.5 | 0.5 |
| Magenta toner | ST-2 | 0.65 | 5 | 86.5 | 1 | 1 | — | 5 | — | 0.5 | 0.5 | 0.5 |
| Yellow toner | ST-3 | 0.55 | 5 | 88.5 | 1 | 1 | — | — | 3 | 0.5 | 0.5 | 0.5 |
| Invisible toner | ST-4 | 0.35 | 5 | 91.5 | 1 | 1 | — | — | — | 0.5 | 0.5 | 0.5 |

Magenta pigment: C.I. Pigment Vioret19, trade name: RED E2B 70 (Clariant)
Cyan pigment: C.I. Pigment Blue15:3, trade name: blue No. 4 (Dainichiseika Color & Chemicals Mfg.)
Yellow pigment: C.I. Pigment Yellow, trade name: Paliotol Y-D1155(BASF)
Infrared absorbent: diimmonium, trade name: NIR-IM1 (Nagase Chemtex)
Fixing aid: ester wax, trade name: WEP-5F (NOF Corporation)
Binder resin: cycloolefin resin, trade name: TOPAS (Ticona)
Charge Controling agent: quaternary ammonium salt, trade name: P-51 (Orient Chemical Industries)
Wax: polyethylene, trade name: Ceridust 2051 (Clariant)
External additive: silica, trade name: TG820F
Resin particle: polymethyl methacrylate fine particles, trade name: NP1451 (Soken Chemical & Engineering)
Titanium oxide: trade name: NKT90 (Nippon Aerosil)

ation is a modified machine of DOCUPRINT 1100CF manufactured by Fuji Xerox Co., Ltd. (output: 400 A4 sheets/min) equipped with eight xenon flash lamps having a high light intensity in the wavelength range of 700 to 1500 in its flash fusing unit. The flash emission is performed in the delayed light emission process in which flash light is emitted twice per unit area. In the delayed light emission, the same printing face is irradiated twice separately by two sets of four lamps having the same optical energy, and the delay time is 1 msec.

A million sheets of paper are printed at an areal printing rate of 4% under the condition above, and the change in lightness (L* value), toner adhesion, and others are evaluated. The recording medium used is plain paper (NIP-1500LT, Kobayashi Kirokushi Co., Ltd.).

Hereinafter, the methods and the criteria for the evaluation above will be described.

(Lightness, L* value)

The L* value of the image in one inch square (2.54 cm×2.54 cm) obtained after printing on 1,000,000 sheets is determined as follows: A density analyzer, X-rite938 manufactured by X-rite, is used for measurement of the optical density, and the L* values obtained in various colors are evaluated according to the following criteria:

A: L* value: 74 or more.

B: L* value: 72 or more and less than 74.

C: L* value: less than 72.

(Evaluation of Toner Adhesion)

The image in one inch square (2.54 cm×2.54 cm) obtained after printing on 1,000,000 sheets is collected as an unfixed image in the unexposed (unfixed) state; the unfixed image is blown with air; and the amount of toner adhesion was evaluated from the difference in weight between before and after blowing, according to the following criteria:

A: Toner adhesion: 0.4 to 0.6 mg/cm$^2$

B: Toner adhesion: 0.3 or more and less than 0.4 mg/cm$_2$, or more than 0.6 mg/cm$_2$ and 0.7 mg/cm$_2$ or less.

C: Toner adhesion: less than 0.3 mg/cm$_2$, or more than 0.7 mg/cm$^2$.

(Evaluation of Toner Concentration Sensor Sensitivity)

The toner concentration is monitored with a magnetic permeability sensor in the evaluation apparatus, and the fluctuation in toner concentration during durability test is evaluated according to the following evaluation criteria.

A: Change in toner concentration: ±1% or less

B: Change in toner concentration: more than ±1% and ±1.5% or less.

The results above are summarized in Table 5.

TABLE 5

| | | Property after printing on 1,000,000 sheets | | | | |
|---|---|---|---|---|---|---|
| | Carrier No | Lightness, L* value | | Toner adhesion (mg/cm$^2$) | | Toner concentration sensor sensitivity |
| Example 1 | 4 | 76 | A | 0.56 | A | A |
| Example 2 | 5 | 77 | A | 0.52 | A | A |
| Example 3 | 6 | 76 | A | 0.53 | A | A |
| Example 4 | 7 | 76 | A | 0.56 | A | A |
| Example 5 | 11 | 72 | B | 0.56 | A | A |
| Example 6 | 12 | 76 | A | 0.57 | A | A |
| Example 7 | 13 | 77 | A | 0.56 | A | A |
| Example 8 | 14 | 77 | A | 0.58 | A | A |
| Example 9 | 15 | 77 | A | 0.34 | B | A |
| Example 10 | 16 | 77 | A | 0.5 | A | A |
| Example 11 | 17 | 77 | A | 0.51 | A | A |

TABLE 5-continued

| | | Property after printing on 1,000,000 sheets | | | | |
|---|---|---|---|---|---|---|
| | Carrier No | Lightness, L* value | | Toner adhesion (mg/cm$^2$) | | Toner concentration sensor sensitivity |
| Example 12 | 18 | 77 | A | 0.59 | A | A |
| Example 13 | 19 | 77 | A | 0.69 | B | A |
| Example 14 | 20 | 77 | A | 0.55 | A | B |
| Example 15 | 21 | 77 | A | 0.59 | A | A |
| Example 16 | 22 | 77 | B | 0.69 | B | A |
| Example 17 | 23 | 77 | A | 0.65 | B | A |
| Example 18 | 24 | 77 | A | 0.52 | A | A |
| Example 19 | 25 | 77 | A | 0.52 | A | A |
| Example 20 | 26 | 77 | A | 0.41 | B | A |
| Example 21 | 27 | 72 | B | 0.52 | A | A |
| Example 22 | 28 | 73 | B | 0.55 | A | A |
| Comparative Example 1 | 1 | 68 | C | 0.52 | A | A |
| Comparative Example 2 | 2 | 70 | C | 0.22 | C | A |
| Comparative Example 3 | 3 | 70 | C | 0.56 | A | A |
| Comparative Example 4 | 8 | 71 | C | 0.56 | A | A |
| Comparative Example 5 | 9 | 70 | C | 0.56 | A | A |
| Comparative Example 6 | 10 | 67 | C | 0.56 | A | A |

Example 23

The modified DOCUPRINT 1100CF is further modified into the train-of-four-tandem machine shown in FIG. 1, and a set of developers containing the carrier 5, YMC toners and an invisible toner is filled in the four developing unit, and a printing test of printing on 1,000,000 sheets is performed.

As a result, even after printing on 1,000,000 sheets, an image favorable without change in lightness, chroma, toner adhesion, and toner concentration is obtained.

As described above, it is found that it is possible to form a high-quality image without separation of carbon black form the carrier surface even in a printing machine in a high-speed process with an output of 400 sheets per minute, by employing the developer using the carrier for electrostatic latent image developer according to the present invention.

In the development of high-speed electrophotographic printers, the present invention can provide a long-lasting electrostatic latent image developer that provides a vivid color image. Further, the invention can provide a carrier for electrostatic latent image developer for obtaining the electrostatic latent image developer and an production method thereof, as well as an image-forming device using the electrostatic latent image developer.

What is claimed is:

1. A carrier for electrostatic latent image developer, comprising a core material and two or more resin-coated layers formed on the surface of the core material, wherein the resin-coated layers comprise a siloxane bond-containing coating resin containing an organic metal compound and a conductive material, a metal contained in the organic metal compound in the innermost resin-coated layer has an ionization potential of less than 7 eV, and a metal contained in the organic metal compound in the outermost resin-coated layer has an ionization potential of 7 eV or more.

2. The carrier for electrostatic latent image developer according to claim 1, wherein the metal contained in the organic metal compound in the innermost resin-coated layer is one or more metals selected from the group consisting of aluminum, titanium, calcium, and barium, and the metal contained in the organic metal compound in the outermost resin-coated layer is one or more metals selected from the group consisting of manganese, tin, cobalt, and zinc.

3. The carrier for electrostatic latent image developer according to claim 1, wherein the conductive material is carbon black, and the content of the carbon black in the innermost layer is in the range of 0.04 to 0.6 parts by mass with respect to 100 parts by mass of the entire carrier and the content of the carbon black in the outermost layer is less than 0.025 parts by mass with respect to 100 parts by mass of the entire carrier.

4. The carrier for electrostatic latent image developer according to claim 1, wherein a coating amount of the outermost resin-coated layer is in a range of 0.1 to 1 part by mass with respect to 100 parts by mass of the entire carrier.

5. The carrier for electrostatic latent image developer according to claim 1, wherein a content of the conductive material in the innermost resin-coated layer is in a range of 0.04 to 0.6 parts by mass with respect to 100 parts by mass of the entire carrier, and a content of the conductive material in the outermost resin-coated layer is less than 0.025 parts by mass with respect to 100 parts by mass of the entire carrier.

6. The carrier for electrostatic latent image developer according to claim 1, wherein the core material comprises manganese ferrite and further comprises silicon atoms in an amount of 0.1 to 0.5 parts by mass based on silicon dioxide ($SiO_2$)conversion per 100 parts by mass of the core material.

7. The carrier for electrostatic latent image developer according to claim 1, wherein a saturation magnetization of the carrier is 65 to 95 $Am^2/kg$ at an applied magnetic field of 3,000 oersteds.

8. The carrier for electrostatic latent image developer according to claim 1, wherein the core material is a ferrite-based core material, and a volume-average particle size of the ferrite-based core material is 30 to 90 μm.

9. The carrier for electrostatic latent image developer according to claim 1, wherein a resistivity of the carrier is $1\times10^3$ to $1\times10^{12}$ Ωcm.

10. An electrostatic latent image developer comprising a toner and a carrier, wherein the carrier is the carrier for electrostatic latent image developer according to claim 1.

11. The electrostatic latent image developer according to claim 10, wherein the toner is one of a cyan toner, a magenta toner, or a yellow toner.

12. The electrostatic latent image developer according to claim 10, wherein a volume average particle size D50v of the toner is 3 to 10 μm.

13. The electrostatic latent image developer according to claim 10, wherein an average degree of roundness of the toner is 0.955 or more.

14. The electrostatic latent image developer according to claim 13, wherein a standard deviation of the average degree of roundness of the toner is 0.04.

15. The electrostatic latent image developer according to claim 10, wherein the toner is an invisible toner.

16. The electrostatic latent image developer according to claim 10, wherein the toner contains an infrared absorbent.

17. An image-forming device comprising:

at least one toner image-forming unit that forms a full color toner image, the toner image-forming unit containing at least three developers of colors including at least cyan, magenta, and yellow, each developer including a color toner and a carrier; and a fixing unit that fixes toner image on a recording medium by performing flash fusing, wherein the color toners contain an infrared absorbent, the carrier includes a core material and two or more resin-coated layers comprising a siloxane bond-containing coating resin containing an organic metal compound and a conductive material on the surface of the core material, a metal contained in the organic metal compound in the innermost resin-coated layer has and ionization potential of less than 7 eV, and a metal contained in the organic metal compound in the outermost resin-coated layer has an ionization potential of 7 eV or more.

18. The image-forming device according to claim 17, wherein a processing speed is 600 mm/sec or more.

19. The image-forming device according to claim 17, wherein a light source for the flash fusing is a flash lamp, and the emitted light energy of the flash lamp is in a range of from 1.0 to 7.0 J/cm.

20. The image-forming device according to claim 17, wherein the fixing unit comprises a plurality of flash lamps and performs delayed flash fusing using the plurality of flash lamps which emit light at a time interval.

* * * * *